US008940149B2

(12) United States Patent
Ahmed et al.

(10) Patent No.: US 8,940,149 B2
(45) **Date of Patent: *Jan. 27, 2015**

(54) GALLIUM ELECTRODEPOSITION PROCESSES AND CHEMISTRIES

(75) Inventors: Shafaat Ahmed, Yorktown Heights, NY (US); Hariklia Deligianni, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/604,060

(22) Filed: Sep. 5, 2012

(65) Prior Publication Data

US 2012/0325668 A1 Dec. 27, 2012

Related U.S. Application Data

(63) Continuation of application No. 12/874,504, filed on Sep. 2, 2010, now Pat. No. 8,545,689.

(51) Int. Cl.

| | |
|---|---|
| ***C25D 3/56*** | (2006.01) |
| ***C25D 3/58*** | (2006.01) |
| ***C25D 5/50*** | (2006.01) |
| ***C25B 1/00*** | (2006.01) |
| ***C25D 3/54*** | (2006.01) |

(52) U.S. Cl.

CPC ... *C25D 3/54* (2013.01); *C25D 3/56* (2013.01)
USPC ..... 205/238; 205/224; 205/228; 205/239; 205/261

(58) Field of Classification Search

CPC ..... C25D 3/38; C25D 3/54; C25D 3/56; C25D 5/50
USPC ..... 205/238, 239, 240, 241, 242, 261, 224, 205/228

See application file for complete search history.

(56) References Cited

U.S. PATENT DOCUMENTS

| | | | |
|---|---|---|---|
| 2,582,377 | A | 1/1952 | Brown |
| 2,793,179 | A | 5/1957 | De La Breteque |
| 3,677,918 | A | 7/1972 | Shigenobu Miyake |
| 3,904,497 | A | 9/1975 | Sleppy et al. |
| 5,744,849 | A | 4/1998 | Sugawa |

(Continued)

FOREIGN PATENT DOCUMENTS

| | | | | |
|---|---|---|---|---|
| EP | 2128903 | A1 | 12/2009 | |
| EP | 2180770 | A1 * | 4/2010 | ..... H05K 3/34 |

(Continued)

OTHER PUBLICATIONS

Yang, "Electrodeposition of GaAs From Aqueous Solutions", Aug. 1990, pp. 1-127.*

(Continued)

*Primary Examiner* — Edna Wong
(74) *Attorney, Agent, or Firm* — Cantor Colburn LLP; Vazken Alexanian

(57) ABSTRACT

Solutions and processes for electrodepositing gallium or gallium alloys includes a plating bath free of complexing agents including a gallium salt, an indium salt, a combination thereof, and a combination of any of the preceding salts with copper, an acid, and a solvent, wherein the pH of the solution is in a range selected from the group consisting of from about zero to about 2.6 and greater than about 12.6 to about 14. An optional metalloid may be included in the solution.

8 Claims, 13 Drawing Sheets

(56) References Cited

U.S. PATENT DOCUMENTS

| | | | | |
|---|---|---|---|---|
| 5,871,630 | A | 2/1999 | Bhattacharya et al. | |
| 6,528,794 | B1 | 3/2003 | Sato | |
| 7,297,868 | B2 * | 11/2007 | Bhattacharya | 136/262 |
| 7,405,098 | B2 | 7/2008 | Lee et al. | |
| 7,498,243 | B2 | 3/2009 | Liu et al. | |
| 7,507,321 | B2 | 3/2009 | Aksu et al. | |
| 7,515,793 | B2 | 4/2009 | Dehlinger et al. | |
| 7,875,522 | B2 | 1/2011 | Kapur et al. | |
| 8,304,272 | B2 | 11/2012 | Assefa et al. | |
| 2003/0150743 | A1 * | 8/2003 | Obata et al. | 205/252 |
| 2005/0173255 | A1 * | 8/2005 | Bokisa et al. | 205/255 |
| 2005/0189231 | A1 * | 9/2005 | Capper et al. | 205/246 |
| 2006/0121701 | A1 * | 6/2006 | Basol | 438/483 |
| 2006/0151331 | A1 | 7/2006 | Taunier et al. | |
| 2007/0004067 | A1 | 1/2007 | Hsu et al. | |
| 2007/0018270 | A1 | 1/2007 | Leon et al. | |
| 2007/0054435 | A1 | 3/2007 | Yoon | |
| 2007/0166964 | A1 | 7/2007 | Basol | |
| 2007/0262296 | A1 | 11/2007 | Bauer | |
| 2007/0272558 | A1 | 11/2007 | Aksu et al. | |
| 2008/0093221 | A1 * | 4/2008 | Basol | 205/170 |
| 2008/0230395 | A1 | 9/2008 | Inbe et al. | |
| 2008/0268138 | A1 * | 10/2008 | Reddington et al. | 427/96.1 |
| 2009/0075102 | A1 * | 3/2009 | Brese et al. | 428/457 |
| 2009/0108384 | A1 | 4/2009 | Assefa et al. | |
| 2009/0145482 | A1 | 6/2009 | Mitzi et al. | |
| 2009/0283415 | A1 | 11/2009 | Aksu et al. | |
| 2010/0140098 | A1 | 6/2010 | Uzoh et al. | |
| 2010/0213073 | A1 * | 8/2010 | Huang et al. | 205/316 |
| 2011/0108115 | A1 * | 5/2011 | Deligianni et al. | 136/262 |
| 2012/0055801 | A1 | 3/2012 | Ahmed et al. | |
| 2012/0061247 | A1 * | 3/2012 | Ahmed et al. | 205/170 |
| 2012/0061250 | A1 * | 3/2012 | Ahmed et al. | 205/310 |
| 2012/0288992 | A1 | 11/2012 | Assefa et al. | |
| 2013/0008798 | A1 | 1/2013 | Ahmed et al. | |
| 2014/0134789 | A1 | 5/2014 | Assefa et al. | |
| 2014/0134790 | A1 | 5/2014 | Assefa et al. | |

FOREIGN PATENT DOCUMENTS

| | | | | |
|---|---|---|---|---|
| KR | 2008068334 A * | 7/2008 | | H01L 23/12 |
| WO | WO2009052479 A2 | 4/2009 | | |

OTHER PUBLICATIONS

Gao et al., "Electrodeposition and Characterization of GaAs Polycrystalline Thin Films", J. Appl. Phys. (Jan. 1, 1994), vol. 75, No. 1, pp. 549-552.*

Mahalingam et al., "Electrosynthesis and Characterization of GaAs in Acid Solutions by Potentiostatic Method", Solar Energy Materials & Solar Cells (no month, 2006), vol. 90, pp. 2456-2463.*

Andreoli, P., et al. "Electrochemical approaches to GaAs1-xSbx thin films" Journal of Electroanalytical Chemistry 385 (1995), (c) 1995 Elsevier Science S.A., pp. 265-268.

Bockris, J. O'M. et al. "Electrodeposition of Gallium on Liquid and Solid Gallium Electrodes in Alkaline Solutions", Supplied by The British Library—Journal of the Electrochemical Society, Jan. 1962, pp. 48-58.

Chen, W.S., et al "Development of thin film polycrystalline Culn1-xGaxSe2 solar cells," 19th IEEE Photovoltaic Specialists Conference, New Orleans, LA, May 4-8, 1987, Proceedings (A88-34226 13-44), 1987, pp. 1445-1447.

Flamini, D.O., et al. "Electrodeposition of gallium onto vitreous carbon" Received May 24, 2006, Accepted Nov. 6, 2006, published online: Jan. 5, 2007; J. Appl. Electrochem (2007); 37, pp. 467-471.

Sundararajan, S. et al. "The Electrodeposition of Gallium from a Chloride Bath", Journal of the Less-Common Metals, II, Received May 28, 1966, pp. 360-364.

International Search Report and Written Opinion issued in International Application No. PCT/EP2011/063558 dated Jan. 3, 2012; 17 pages.

K. Toko et al., "Defect-Free single-crystal Ge island arrays on insulator by rapid-melting-growth combined with seed-positioning technique," Applied Physics Letters 95, 112107; Sep. 18, 2009, pp. 1-3.

M. Miyao et al., "High-quality single-cyrstal Ge stripes on quartz substrate by rapid-melting-growth," Applied Physics Letters 95, 022115; Jul. 17, 2009, pp. 1-3.

Notice of Allowance for U.S. Appl. No. 13/024,724; Filing Date: Feb. 10, 2011; First Named Inventor: Solomon Assefa; Mailing Date: Jun. 26, 2012.

International Search Report; International Application No. PCT/EP2011/060377; International Filing Date: Jun. 21, 2011; Date of Mailing: Jan. 6, 2012.

International Search Report—Written Opinion; International Application No. PCT/EP2011/060377; International Filing Date: Jun. 21, 2011; Date of Mailing: Jan. 6, 2011.

Invitation to Pay Additional Fees and Where Applicable, Protest Fee, issued in International Application No. PCT/EP2011/063561, dated May 18, 2012; 6 pages.

S. Assefa, et al., "CMOS-Integrated 40GHz Germanium Waveguide Photodetector for On-Chip Optical Interconnects," 2009 Conference on Optical Fiber Communication, copyright 2009 IEEE, pp. 1-3.

S. Assefa, et al., "CMOS-Integrated Optical Receivers for On-Chip Interconnects," IEEE Journal of Selected Topics in Quantum Electronics, vol. 16, No. 5, Sep./Oct. 2010, pp. 1376-1385.

S. Assefa, et al., "Reinventing Germanium Avalanche Photodetector for Nanophotonic On-Chip Optical Interconnects," Copyright 2010, Macmillan Publisher Limited, vol. 464, No. 4, Mar. 4, 2010, Nature, pp. 80-85.

S. Assefa, et al., "CMOS-Integrated High-Speed MSM Germanium Waveguide Photodetector," Optics Express, Mar. 1, 2010, vol. 18, No. 5, Copyright 2010 OSA, pp. 1-14.

S. Wolf, et al., "Ion Implantation for VLSI," Silicon Processinf for the VLSI Era, vol. 1, Lattice Press, Copyright 1986, pp. 280-330.

V. A. Vu, et al., "PIN Germanium Photodetector Fabrication Issues and Manufacturability," IEEE Transactions on Semiconductor Manufacturing, vol. 23, No. 3, Aug. 2010, pp. 411-418.

Notification of Transmittal of the International Search Report and the Written Opinion of the International Searching Authority, or the Declaration, issued in International Application No. PCT/EP2011/063561 on Aug. 1, 2012; 16 pages.

Final Office Action issued in U.S. Appl. No. 12/874,504 dated Jan. 28, 2013; 17 pages.

Non-Final Office Action issued in U.S. Appl. No. 12/874,504 dated Sep. 27, 2012; 35 pages.

Amendment to Office Action Filed in U.S. Appl. No. 12/874,504, dated Dec. 19, 2012; 10 pages.

Amendment to Office Action Filed in U.S. Appl. No. 12/874,504, dated Mar. 18, 2013; 6 pages.

Amendment to Final Office Action Filed in U.S. Appl. No. 13/556,597, dated Jun. 19, 2013; 7 pages.

Final Office Action issued in U.S. Appl. No. 13/556,597 dated Apr. 25, 2013; 8 pages.

Final Office Action issued in U.S. Appl. No. 12/874,496 dated Apr. 26, 2013; 13 pages.

Notice of Allowance issued in U.S. Appl. No. 12/874,504 dated May 22, 2013; 12 pages.

B-H. Tseng, et al., "Influence of Sb on the Growth and Properties of CuInSe2 Thin Films", Japanese Journal of Applied Physics 34, p. 1109-1112 (1995).

M. Yuan, et al., "Optimization of CIGS-based PV Device Through Antimony Doping", Chemistry of Materials 22, p. 285-287 (2010).

Non-Final Office Action issued in U.S. Appl. No. 12/874,496, dated Sep. 3, 2013; 17 pages.

Y. Akaki, et al., "Structural, Electrical and Optical Properties of Bi-doped CuInS2 Thin Films Grown by Vacuum Evaporation Method", Physica Status Solidi (C) 8, p. 2597-2600 (2006).

Y. Oda, Electrodeposited CuGa(Se,Te) 2 Thin-Film Prepared from Sulfate Bath, Physica Status Solidi (C) 8, p. 2581-2584 (2006).

Yang, Ming-Chang. "Electrodeposition of GaAs from Aqueous Solutions", Supplied by University of Microfilms International, Aug. 1990, 146 pgs.

* cited by examiner

GALLIUM ELECTRODEPOSITION PROCESSES AND CHEMISTRIES

CROSS REFERENCE TO RELATED APPLICATIONS

The present application is a continuation of and claims priority to U.S. patent application Ser. No. 12/874,504, filed Sep. 2, 2010, now U.S. Pat. No. 8,545,689, the contents of which are incorporated by reference in its entirety.

BACKGROUND

This invention generally relates to electrodeposition solutions and processes for forming metal containing films, and more particularly, to electrodeposition solutions and processes for depositing films of gallium, indium, a combination thereof, and a combination of any of the preceding with copper.

Current processes for electroplating metal containing thin films such as gallium and gallium alloys present numerous problems. These problems include, among others, low cathodic deposition efficiency due to excessive hydrogen generation, poor repeatability of the process, partly due to the poor cathodic efficiency, and the poor quality of the deposited films such as their high surface roughness and poor morphology. Gallium is generally considered a difficult metal to deposit without excessive hydrogen generation on the cathode because gallium plating potential is relatively high. Hydrogen generation on the cathode causes the deposition efficiency to be less than 100% because some of the deposition current gets used on forming the hydrogen gas rather than for forming the gallium film on the substrate or cathode. Moreover, hydrogen generation and evolution is a causal factor for introducing porosity into the deposited film, thereby contributing to increased surface roughness and microdefects. The plating efficiencies inherently reduce the repeatability of an electrodeposition process because hydrogen generation itself is a strong function of many factors including impurities in the electrolyte, deposition current density, small changes on the morphology or chemistry of the substrate surface, temperature, mass transfer, and the like.

Accordingly, there is a need in the art for improved electroplating processes and chemistries that deposit uniform, substantially defect free, and smooth thin films with high plating efficiency and repeatability.

SUMMARY

The present invention is generally directed to solutions and methods for electrodeposition of a substrate. In one aspect, the solution for electrodeposition of the metal containing film comprises a metal salt, wherein the metal is selected from the group consisting of gallium, indium, a combination thereof, and a combination of any of the preceding with copper; an acid selected from the group consisting of an alkane acid, an alkene acid, an aryl acid, a heterocyclic acid, an aromatic sulfonic acid, an aromatic sulfuric acid, hydrochloric acid, perchloric acid, and nitric acid; optionally a metalloid compound wherein the metalloid compound is selected from the group consisting of arsenic, antimony, bismuth, a combination thereof; and a solvent to dissolve said metal salt, wherein the pH of the solution is in a range selected from the group consisting of from about zero to about 2.6 and greater than about 12.6 to about 14, and wherein the solution is free of a complexing agent.

The method for electrodepositing a substrate comprises contacting (i) a solution comprising a metal salt, wherein the metal is selected from the group consisting of gallium, indium, a combination thereof, and a combination of any of the preceding with copper; optionally an inorganic metalloid compound; further optionally an organic additive having at least one sulfur atom; and a solvent to dissolve said metal salt, wherein the solution is free of a complexing agent; and (ii) a substrate; adjusting pH of the solution to a range selected from the group consisting of from about zero to about 2.6 and greater than about 12.6 to about 14; and applying a current to electroplate the substrate with a metal containing film.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE SEVERAL VIEWS OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
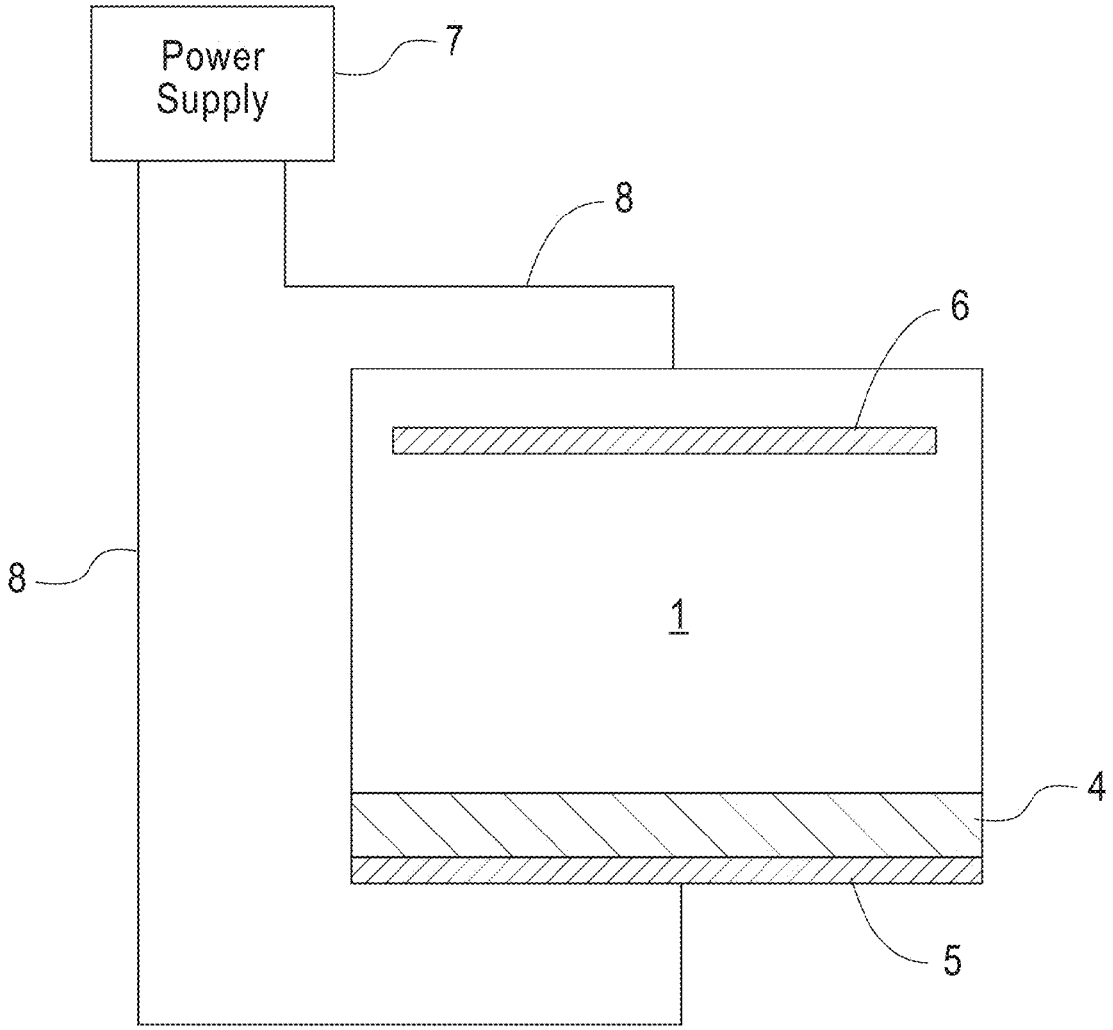
FIG. 1 schematically illustrates an exemplary electrodeposition process for depositing gallium onto a substrate.

The detailed description explains the preferred embodiments of the invention, together with advantages and features, by way of example with reference to the drawings.

DETAILED DESCRIPTION

The present invention provides low cost electrodeposition processes for forming thin layers of gallium, indium, a combination thereof, and a combination of any of the preceding with copper onto conductive or non-conductive surfaces.

The electrodeposition processes utilize electroplating solutions to deposit compositionally pure, uniform, substantially defect free, and smooth thin films with high plating efficiency and repeatability. The electroplating solutions are free of complexing agents and can be practiced at both high and low pH ranges. In some embodiments, the thin layers may include alloys thereof. Examples of desirable gallium alloys include, without limitation, binary, ternary or higher order alloys of silver, copper, indium, zinc, tin, lead, silver, bismuth, gold, selenium, sulfur, and the like. Optionally, the alloy can be formed by annealing a film stack including an electrodeposited gallium and/or indium layer and one or more alloying element metal layers. In this manner, low cost fabrication of thin films can be formed, wherein the resulting layer is of uniform thickness, excellent morphology, and substantially defect free.

In one embodiment, the electrodeposition processes generally include electroplating a substrate surface (working electrode) disposed in a plating bath comprising a gallium salt, a methane sulfonic acid (MSA) electrolyte, and a solvent. The pH of the bath can be controlled using an acid or a base. The concentration of metal ions in the electrolyte generally may range from about 0.000005 Molar (M) M up to molar concentrations close to the saturation limit in the electrolyte and pH used. Useful gallium sources include gallium salts soluble within the plating bath including, without limitation, gallium chloride ($GaCl_3$), gallium bromide ($GaBr_3$), gallium iodide ($GaI_3$), gallium nitrate $Ga(NO_3)_3$, gallium sulfate $Ga(SO_4)_3$, mixtures thereof, and the like. Other suitable gallium salts include salts of sulfuric acid, sulfamic acid, alkane sulfonic acid, aromatic sulfonic acid, fluoroborate, and strong bases such as sodium hydroxide, potassium hydroxide, lithium hydroxide, calcium hydroxide, magnesium hydroxide, and the like. Useful indium sources include, without limitation, indium chloride, indium sulfate, indium acetate, indium carbonate, indium nitrate, indium perchlorate, indium phosphate, indium oxide, indium hydroxide, and the like.

The concentration of acid such as MSA in the electrolyte may range from about 0.1 M to about 2 M; in other embodiments, the concentration is in a range of about 0.1 M to 1 M; and in still other embodiments, the concentration is in a range of 0.5 M to 1 M. As described, the electrolyte bath is free from any kind of organic or inorganic complexing agents. That is, the gallium salt is soluble within the electrolyte bath.

The pH of the electrolyte bath is generally less than 2.6 or greater than 12.6. Applicants have discovered that the plating bath becomes cloudy, i.e., milky like in appearance, when the solution pH is in the range of about zero to 2.6 or greater than about 12.6 to about 14. While not wanting to be bound by theory, it is believed that oxides and/or hydroxides of gallium are formed within these pH ranges, e.g., gallium oxides and hydroxides in aqueous solutions. Suitable acids or bases to provide and maintain the pH of the electrolyte bath are exclusive of complexing agents and may include, without limitation, mineral acids such as sulfuric acid, organic acids such as methane sulfonic acid, ethane sulfonic acid, propane sulfonic acid, butane sulfonic acid or other alkane sulfonic acid and aromatic sulfonic acid such as benzene sulfonic acid, toluene sulfonic acid. Advantageously, it has been discovered that the electrodeposition processes at these pH ranges provide a uniform, thin conformal metal containing layer, thereby preventing individual island formation.

The electroplating bath may further include an optional organic additive comprising at least one nitrogen atom or at least one sulfur atom. The organic additive is added to the plating bath to effectively increase hydrogen evolution overpotential and prevent or effectively limit the co-deposition/evolution of hydrogen during plating of gallium and to control microstructure of the deposit by controlling nucleation and growth. Advantageously, the additive also functions as a brightener and grain refiner while concomitantly assisting with nucleation. The thinnest layers are formed by instantaneous nucleation where the same size islands form simultaneously on a surface. Also, thin layers can be formed by progressive nucleation where formation of islands is a function of time. In doing so, the resulting metal film containing layer is uniform and conformal, thereby preventing large three dimensional island formation during deposition. Exemplary organic additives include, without limitation, aliphatic and/or heterocyclic compounds such as thioureas, thiazines, thiosulfates, sulfides, sulfonic acids, sulfonic acids, allyl phenyl sulfone, sulfamides, imidazoles, amines, isonitriles, dithioxo-bishydroxylaminomolybdenum complex, and derivatives thereof.

The organic additive comprising the at least one nitrogen atom and/or at least one sulfur atom additive has been found to unexpectedly accelerate plating while suppressing hydrogen evolution. In this manner, it has been discovered that the organic additive provides a synergistic effect when employed in combination with the electrolyte, e.g., MSA. The concentration of the organic additive comprising the at least one nitrogen atom and/or at least one sulfur atom may range from about 1 parts per million (ppm) to about 10,000 ppm, in other embodiments, the organic additive is in a range of about 10 ppm to 5000 ppm, and in still other embodiments, the organic additive is in a range of 100 ppm to 1,000 ppm.

In other embodiments, an optional inorganic metal oxide is added, optionally in combination with the organic additive, to poison the cathode, thereby increasing the onset over-potential of hydrogen evolution (i.e., inhibit hydrogen generation) and accelerate metal containing film deposition. The inorganic metal oxide includes, without limitation, oxides of metalloids such as arsenic oxides (e.g., $As_2O_3$; $As_2O_5$, $KH_2AsO_4$, $K_2HAsO_4$, $K_3AsO_4$, $K_3AsO_3$, $KAsO_2$, $NaH_2AsO_4$, $Na_2HAsO_4$, $Na_3ASO_4$, $Na_3ASO_3$, $NaAsO_2$, $Na_4AS_2O_7$, and the like); antimony oxides, (e.g., $Sb_2O_3$, $Sb_2O_5$, $KH_2SbO_4$, $K_2HSbO_4$, $K_3SbO_4$, $K_3SbO_3$, $KSbO_2$, $NaH_2SbO_4$, $Na_2HSbO_4$, $Na_3SbO_4$, $Na_3SbO_3$, $NaSbO_2$, $Na_4Sb_2O_7$, and the like); and bismuth oxides (e.g., $Bi_2O_3$, $K_3BiO_3$, $KBiO_2$, $Na_3BiO_3$, $NaBiO_2$ and the like); and mixtures thereof. Metal deposition and hydrogen evolution are known to occur simultaneously, and thus, prior art plating processes generally exhibit low plating efficiencies in order to prevent hydrogen evolution, which contributes to porosity within the deposited film structure The metal oxides described above are effective cathodic poisons and advantageously increase the onset of over-potential of hydrogen evolution and unexpectedly accelerate gallium deposition. Plating efficiencies greater than 90 to 95% have been observed with gallium plating solutions including the combination of the metal oxide and the organic additive comprising at least one nitrogen atom and at least one sulfur atom. The concentration of metal oxide in the electrolyte may range from about 1 parts per million (ppm) to about 10,000 ppm, in other embodiments, the metal oxide is in a range of about 100 ppm to 5,000 ppm, and in still other embodiments, the metal oxide is in a range of 1,000 ppm to 3,000 ppm.

In another embodiment, the plating bath includes a gallium salt, a sodium sulfate ($Na_2SO_4$) electrolyte, an organic additive comprising the at least one nitrogen atom and/or at least one sulfur atom, and a solvent. The concentrations of the gallium salt and the organic additive are as previously described. The concentration of sodium sulfate as the electrolyte may range from about 0.01 M to about 2 M; in other embodiments, the sodium sulfate is in a range of about 0.1 M to 1 M; and in still other embodiments, the sodium sulfate is in a range of 0.2 M to 60 M. Optionally, the metal oxide as described above may be included in plating bath. The pH is less than 2.6 or greater than 12.6 as previously described.

In the various embodiments described above, the electroplating chemistry can be used on conductive and non-conductive substrates. Suitable conductive substrates include, without limitation, gold, molybdenum, indium copper, selenium, zinc, and the like. Suitable non-conductive substrates generally are those having a metal seed layer thereon and include, without limitation, glass, quartz, plastic, polymers, and the like. For example, the non-conductive substrate may include a seed layer. The particular method for depositing the seed layer is not limited and is well within the skill of those in the art. For example, the seed layer may be formed by physical vapor deposition, chemical vapor deposition, plasma vapor deposition, electrolytic or electroless deposition.

The electroplating baths may also comprise additional ingredients. These include, but are not limited to, grain refiners, surfactants, dopants, other metallic or non-metallic elements etc. For example, other types of organic additives such as surfactants, suppressors, levelers, accelerators and the like may be included in the formulation to refine its grain structure and surface roughness. Organic additives include but are not limited to polyalkylene glycol type polymers, polyalkane sulfonic acids, coumarin, saccharin, furfural, acryonitrile, magenta dye, glue, starch, dextrose, and the like.

Although water is the preferred solvent in the formulation of the plating baths, it should be appreciated that organic solvents may also be added in the formulation, partially or wholly replacing the water. Such organic solvents include but are not limited to alcohols, acetonitrile, propylene carbonate, formamide, dimethyl sulfoxide, glycerin etc.

Although DC voltage/current can be utilized during the electrodeposition processes, it should be noted that pulsed or other variable voltage/current sources may also be used to obtain high plating efficiencies and high quality deposits. The temperature of the electroplating baths may be in the range of 5 to 90° C. depending upon the nature of the solvent. The preferred bath temperature for water based formulations is in the range of 10-80° C.

As shown in FIG. 1, in practice, a backside electrical contact 5 is made to a conductive substrate 4, which functions as the working electrode, upon which gallium or indium is to be electrodeposited. Alternatively, if the substrate is non-conducting, a conductive layer and/or a seed layer can first be deposited and electrical contact can be made directly to the seed layer via ohmic contact or to the underlying conductive layer. An electrolyte solution 1 in accordance with the present disclosure is placed in contact with the substrate surface. A conductive counter electrode 6, i.e., anode or conductor, is positioned in the electrolyte solution and spaced apart from the substrate (working electrode). While the substrate 4 is shown as having a planar surface, it is understood that substrate 4 can also have some topography and/or conformal conductive layers thereon. For electrochemical processing, an electrical current or voltage is applied to the substrate (electrode) 4 and the counter electrode 6 via a power supply 7 and electrical leads 8. If desired, the electrochemical potential of the structure/electrolyte can be controlled more accurately by the introduction of a third electrode, that is, a reference electrode (not shown), which has constant electrochemical potential. Examples of reference electrodes include a saturated calomel electrode (SCE) and silver-silver chloride (Ag/AgCl) reference electrodes or other metal reference electrodes such as Cu or Pt. The electrolyte solution can be agitated during electrodeposition.

The following examples are presented for illustrative purposes only, and are not intended to limit the scope of the invention.

Example 1

In this example, various aqueous gallium plating baths in sodium sulfate with and without thiourea as the organic additive comprising at least one nitrogen atom and at least one sulfur atom were used to electrodeposit gallium onto glass substrates having thereon a molybdenum layer that had previously been seeded with copper. In this example, the pH was adjusted using $H_2SO_4$ or NaOH. A gallium chloride salt was employed. The electrolyte bath was at 18-20° C. The various gallium plating chemistries are shown in Table 1.

TABLE 1

| Gallium ($Ga^{3+}$) (M) | $Na_2SO_4$ (M) | Organic Additive (ppm) | pH |
|---|---|---|---|
| 0.1 | 0.5 | — | 0.11 |
| 0.2 | 0.5 | — | 0.02 |
| 0.2 | 0.5 | 1 | 0.02 |
| 0.2 | 0.5 | 10 | 0.11 |
| 0.2 | 0.5 | 20 | 0.12 |
| 0.2 | 0.5 | 30 | 0.11 |

Figure 2:
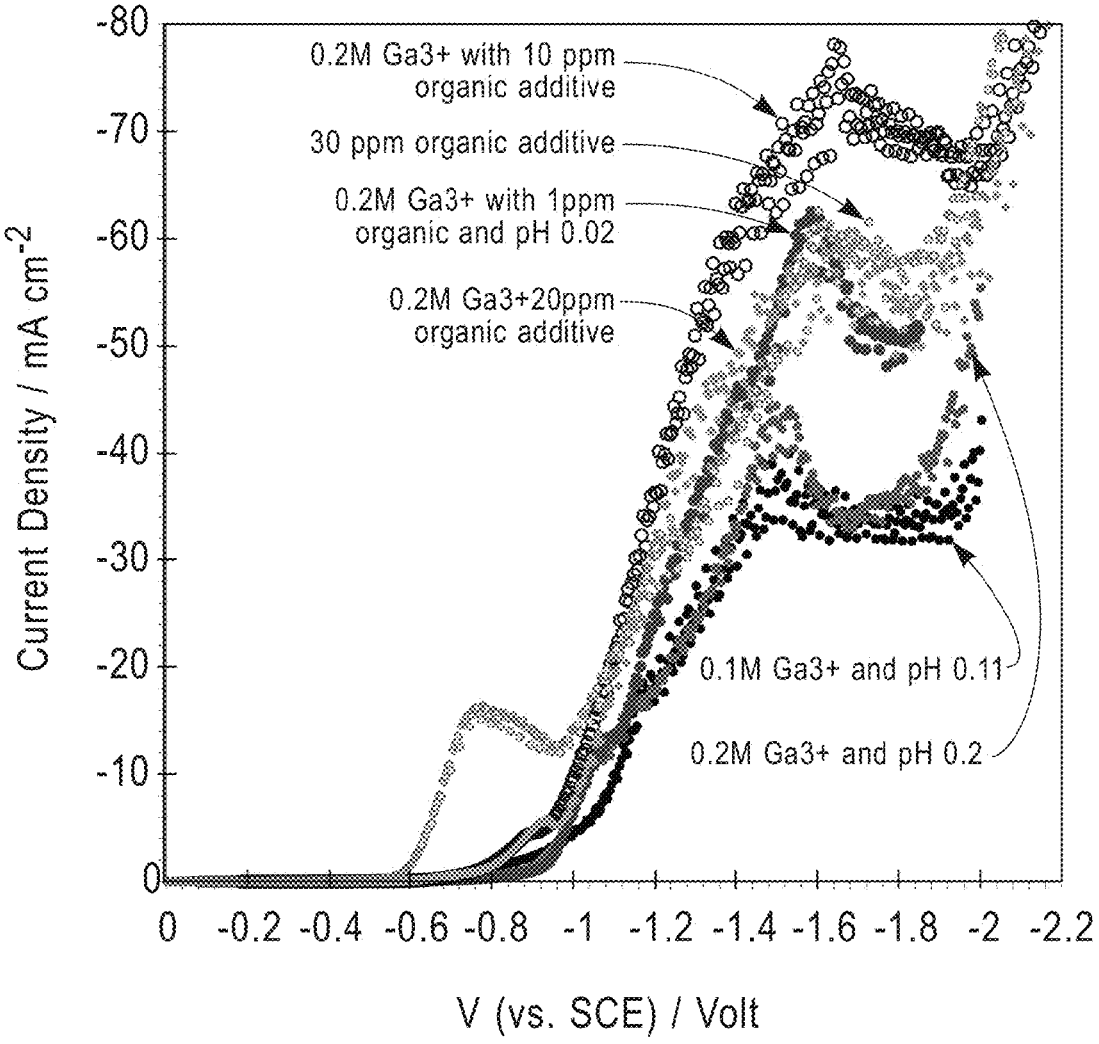
FIG. 2 graphically illustrates current-voltage curves for gallium from a sulfate containing acidic solution with and without varying levels of an organic thiourea additives at 550 rpm in accordance with the present disclosure.

The results are graphically shown in the current-voltage potential curves of FIG. 2. All electrode potentials in this and the following examples are relative to a standard calomel electrode (SCE). Highly adherent gallium films were obtained with a surface roughness of less than 5 nm for a thickness of about 150 nm. The plating efficiency was 50-55%. No hydrogen evolution was observed during plating. The resultant gallium films were shiny, silvery white, smooth and substantially defect free. Moreover, the presence of the organic additive clearly accelerated gallium plating and inhibited hydrogen evolution relative to plating baths that did not contain the organic additive.

Example 2

Figure 3:
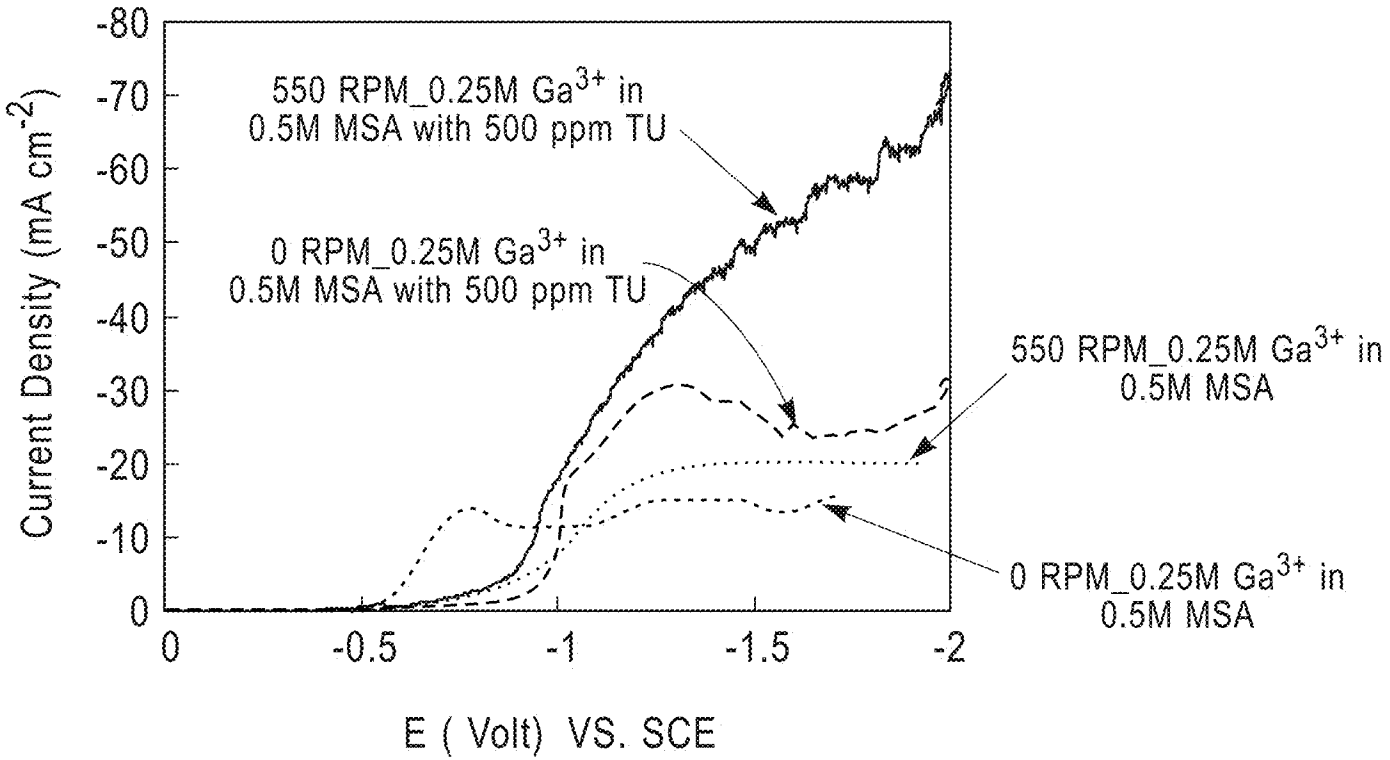
FIG. 3 graphically illustrates current-voltage curves for gallium from a methane sulfonate acidic solution with and without agitation and/or an organic thiourea additive in accordance with the present disclosure.

In this example, various gallium plating baths with and without the organic additive were used to electro deposit gallium onto glass substrates having thereon a molybdenum layer that had previously been seeded with copper. The plating solution included 0.25 M gallium sulfate in 0.5 M MSA with 0 and 500 ppm of thiourea. The electrolyte bath was at 18-20° C. and agitated at 0 and 550 rpm. The pH was maintained at 1.14 using $H_2SO_4$. The corresponding current-voltage curves are shown in FIG. 3.

Figure 4:
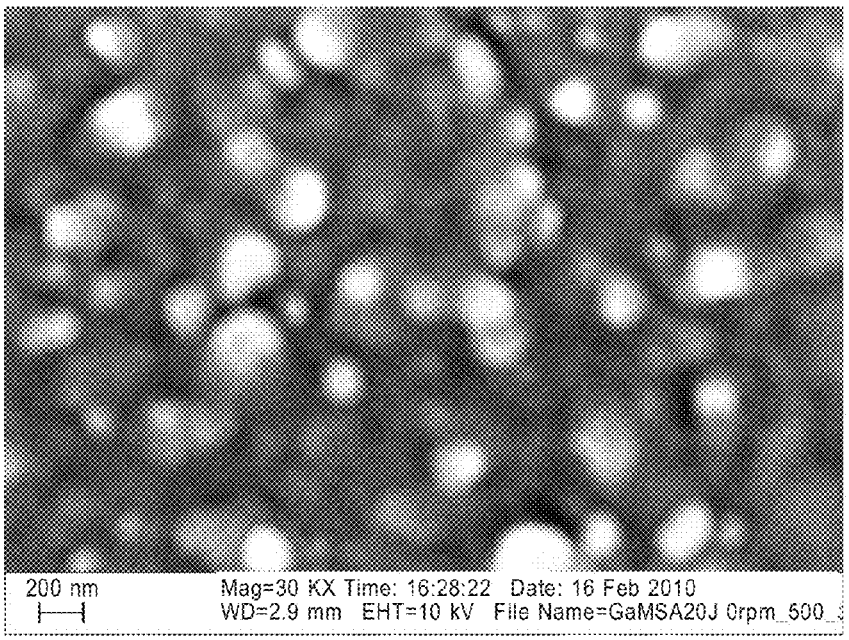
FIGS. 4 and 5 show scanning electron micrographs of top down views of gallium galvanostatically deposited from an acidic methane sulfonic acid solution with added thiourea at 20 and 30 mAcm-$^{2}$, respectively.
Figure 5:
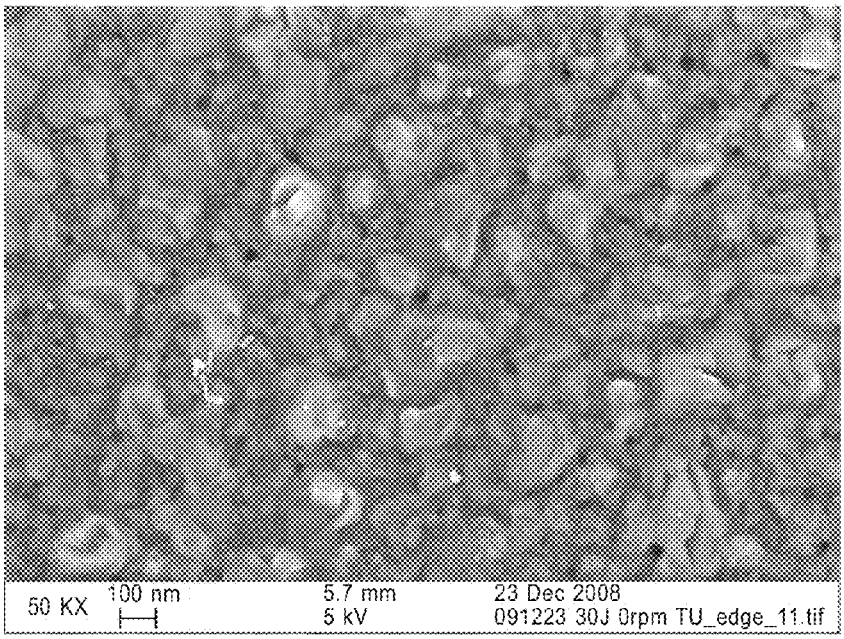
Figure 6:
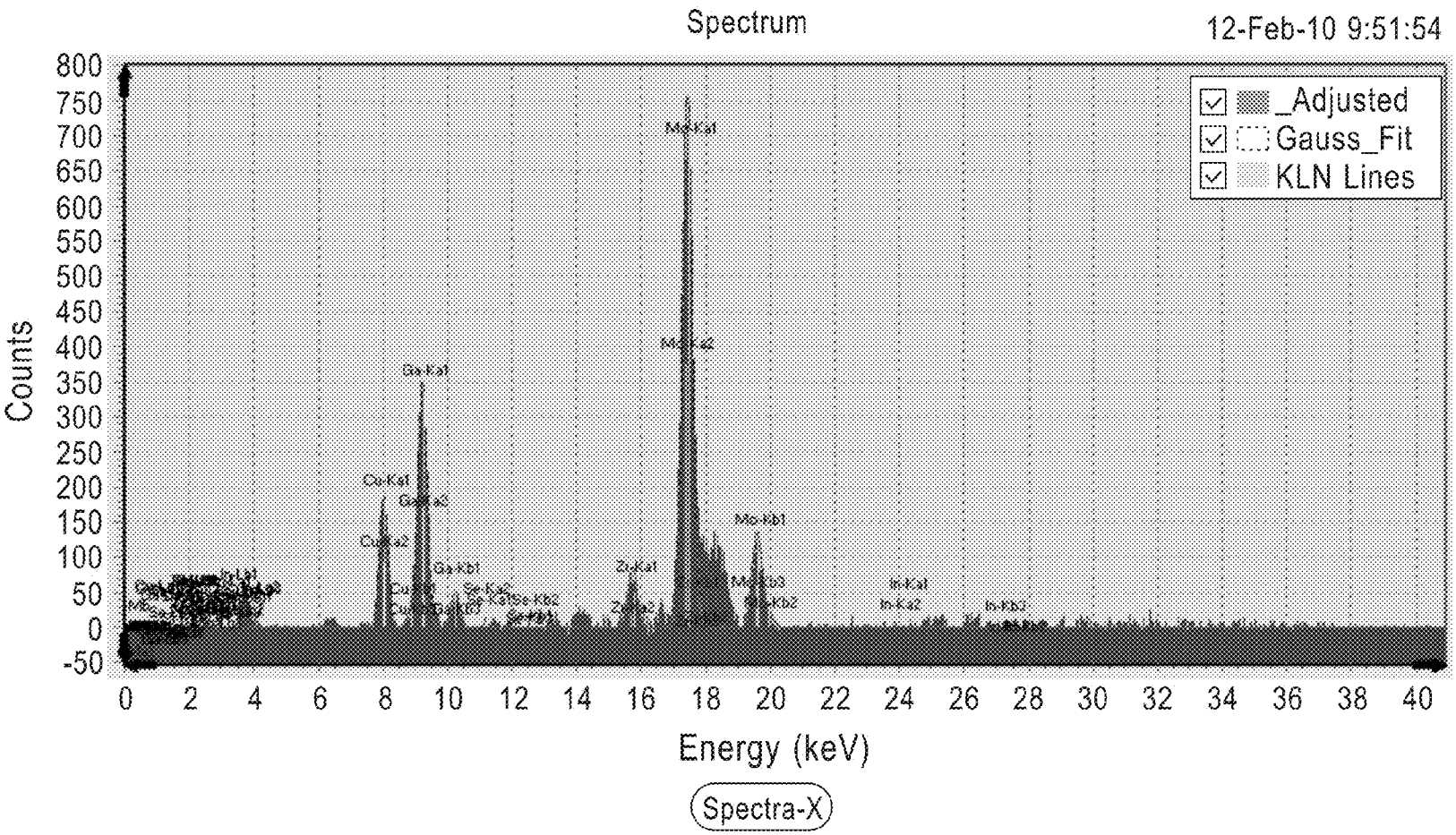
FIG. 6 exhibits the XRF patterns of deposited gallium film galvanostatically deposited from an acidic methane sulfonic acid solution with added thiourea at 20 mA/cm$^{2}$ in accordance with the present invention.
Figure 7:
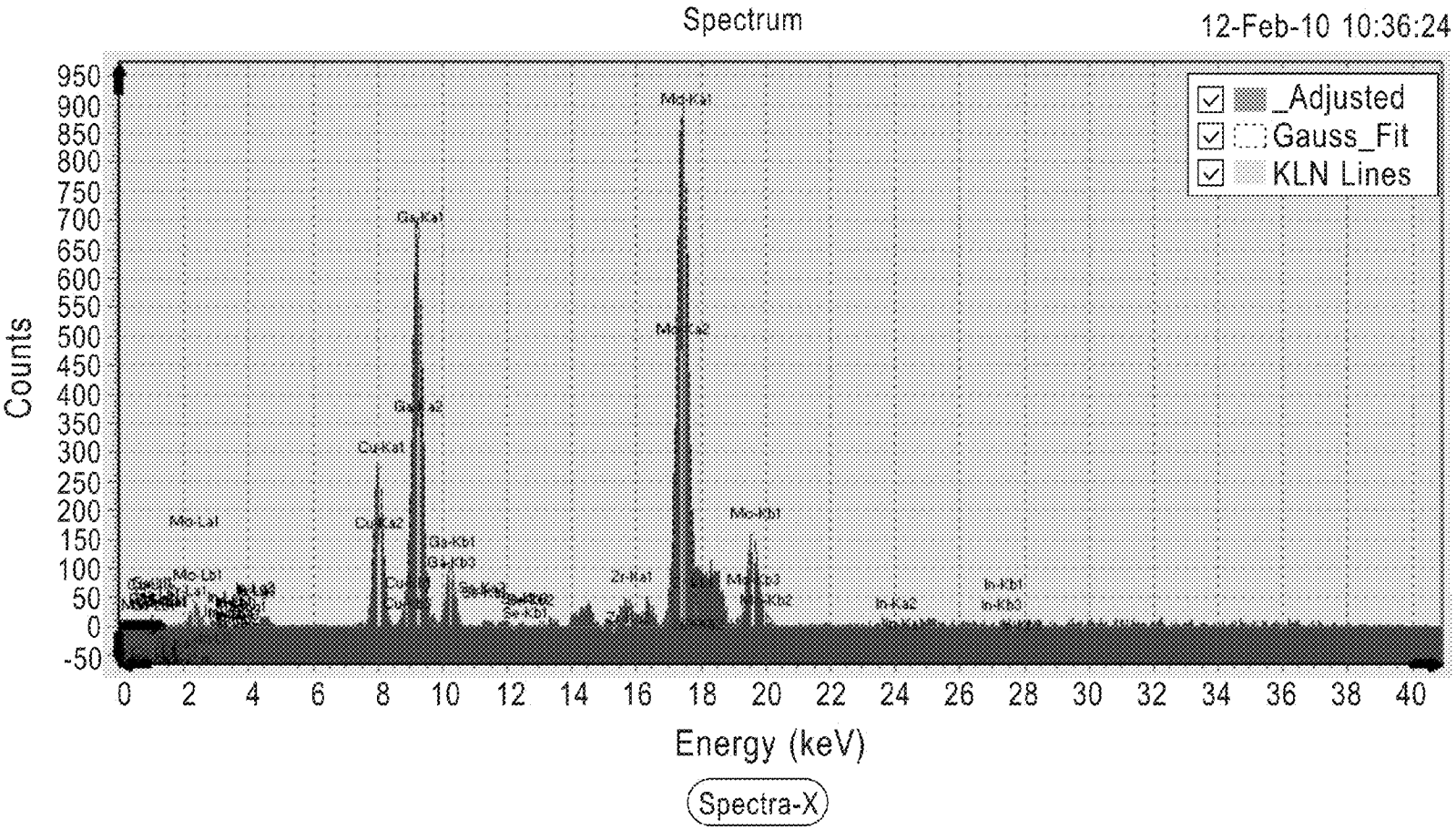
FIG. 7 exhibits the XRF patterns of deposited gallium film galvanostatically deposited from an acidic methane sulfonic acid solution with added thiourea at 30 mA/cm$^{2}$ in accordance with the present invention.

The results show that the presence of the organic additive clearly accelerated gallium plating relative to plating baths that did not contain the organic additive. Moreover, continuous agitation of the electrolyte provided significantly higher current densities than without. FIGS. 4 and 5 pictorially illustrate surface topographic views of the galvanostatically deposited gallium film at 20 mA/cm$^2$ and 30 mA/cm$^2$, respectively. An increase in grain size was observed with the increased current density. No porosity was observed and the films were uniform and of excellent morphology. FIGS. 6 and 7 exhibit the XRF patterns of deposited gallium film galvanostatically deposited at 20 mA/cm$^2$ and at 30 mA/cm$^2$, respectively. It can be seen that the deposition rate is higher at higher current density.

Example 3

In this example, the plating bath included 0.2 M $Ga^{3+}$ in 0.5M MSA and 0.5M NaOH, wherein the pH was then adjusted to be in a range of about 0.5 to about 2.6 using MSA. The $Ga^3$ in MSA was quenched with the NaOH and then adjusted by adding more MSA.

Figure 8:
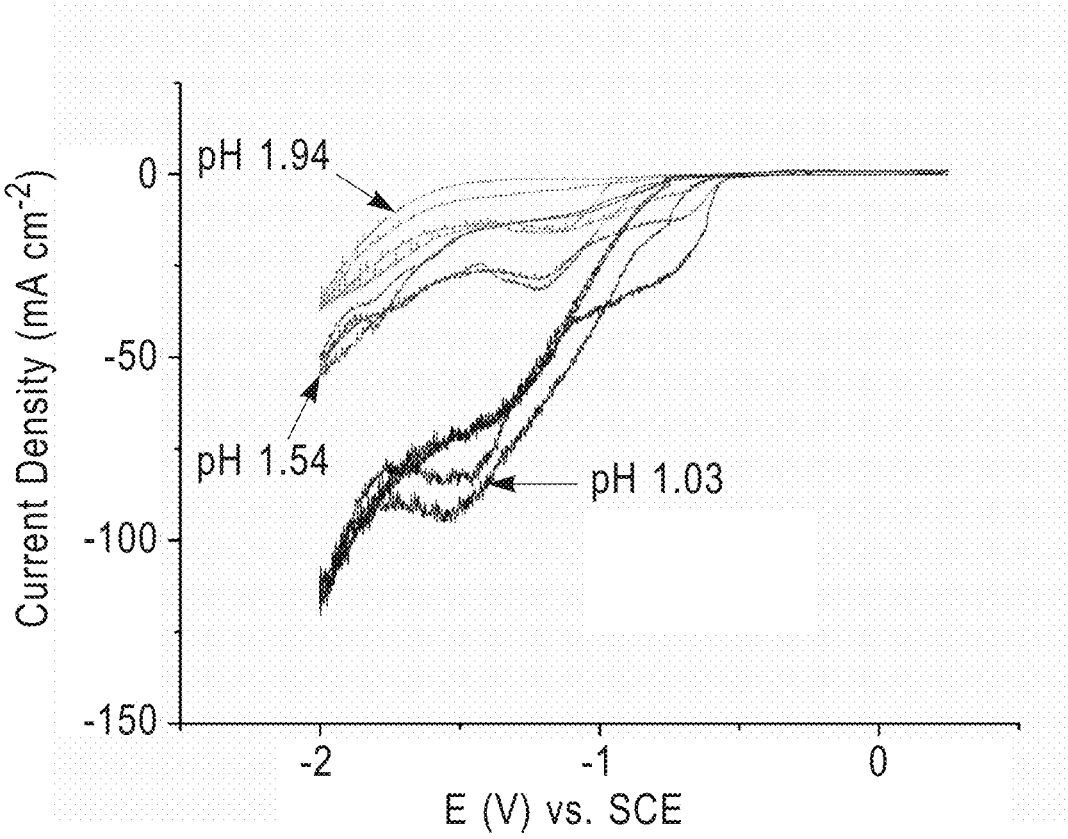
FIG. 8 graphically illustrates cyclic voltammetry plots at scan rates of 100 mV s$^{-1}$ for different pH values of gallium plating baths containing methane sulfonic acid quenched with sodium hydroxide, wherein the pH values were lowered with additional amounts of methane sulfonic acid.
Figure 9:
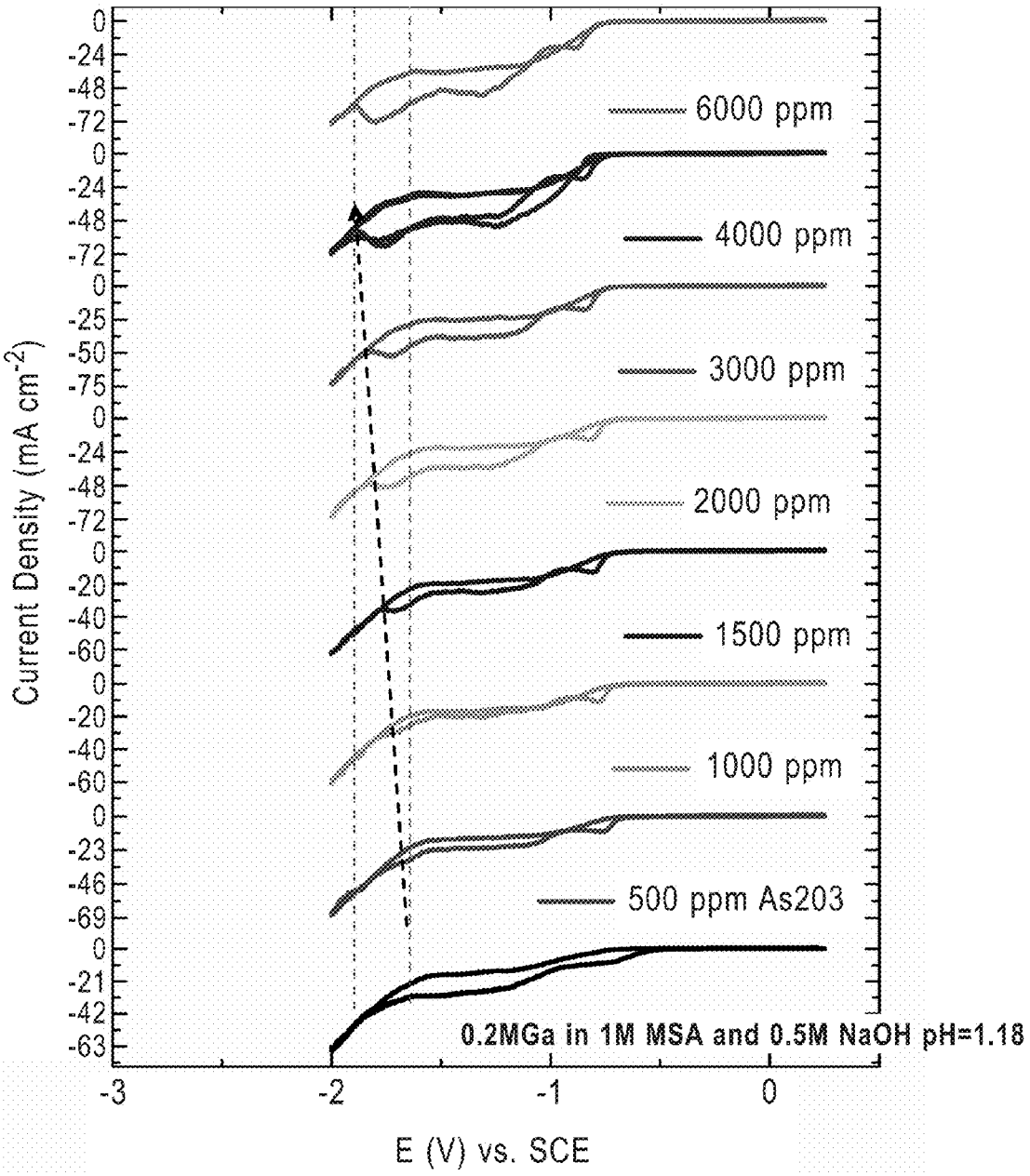
FIGS. 9 and 10 graphically illustrate cyclic voltammetry plots for different levels of arsenic trioxide in gallium plating baths containing methane sulfonic acid quenched with sodium hydroxide, wherein the pH was lowered to 1.18 with additional amounts of methane sulfonic acid.

FIG. 8 illustrates cyclic voltammetry plots at a scan rate of 100 mVs$^{-1}$. The cathodic potentials (limiting current, $i_L$) at the varying pH values shown in FIG. 9 are shown in Table 2 below.

TABLE 2

| pH | $i_L$ (mA cm$^{-2}$) |
|---|---|
| 1.03 | 100 |
| 1.54 | 28 |
| 1.94 | 15 |

When $Ga^{3+}$ in MSA was quenched with NaOH and then adjusted by adding more MSA to obtain a pH of 0.5 to 2.6, a higher deposition rate and plating efficiencies greater than 65% were observed. Hydrogen evolution was substantially eliminated. Similar results have been obtained adding additional NaOH in place of MSA to raise the pH to 12.6 to 13.6. The cathodic current density was highest at pH ranges of about 1 to about 1.25 and also for high pH e.g. pH>13.

Example 4

In this example, gallium was electroplated onto a film stack and subsequently annealed to form an indium rich indium-gallium alloy. The plating chemistry included 0.2M $Ga^{3+}$ in 0.5M MSA quenched with 0.5 M NaOH and then adjusted to a pH of 1.21 using additional amounts of MSA. Gallium was electroplated onto a 360 nm indium layer and a 250 nm copper layer. The gallium layer with a thickness of 150 nm was subsequently self-annealed at room temperature (18-22° C.) for a period of 3 days. Upon plating gallium on indium, interdiffusion had onset immediately and progressively formed an In—Ga eutectic alloy. Interestingly, the Ga interdiffusion did not stop at the indium layer and continued into the copper forming an alloy of CuInGa.

Example 5

In this example, the plating bath included $Ga^{3+}$ in 0.5M MSA quenched with 0.5M NaOH and then adjusted by adding more MSA to obtain a pH of 1.18. Varying amounts of $As_2O_3$ were included in the plating bath, where indicated. For the plating bath that included no $As_2O_3$ or thiourea, the plating bath included $Ga^{3+}$ in 0.5 M MSA quenched with 0.5 M NaOH with the pH adjusted to 1.18 using additional MSA. The plating bath that included a combination of $As_2O_3$ and thiourea contained $As_2O_3$ was at 500-6000 ppm and the thiourea was at 100-1000 ppm.

Figure 10:
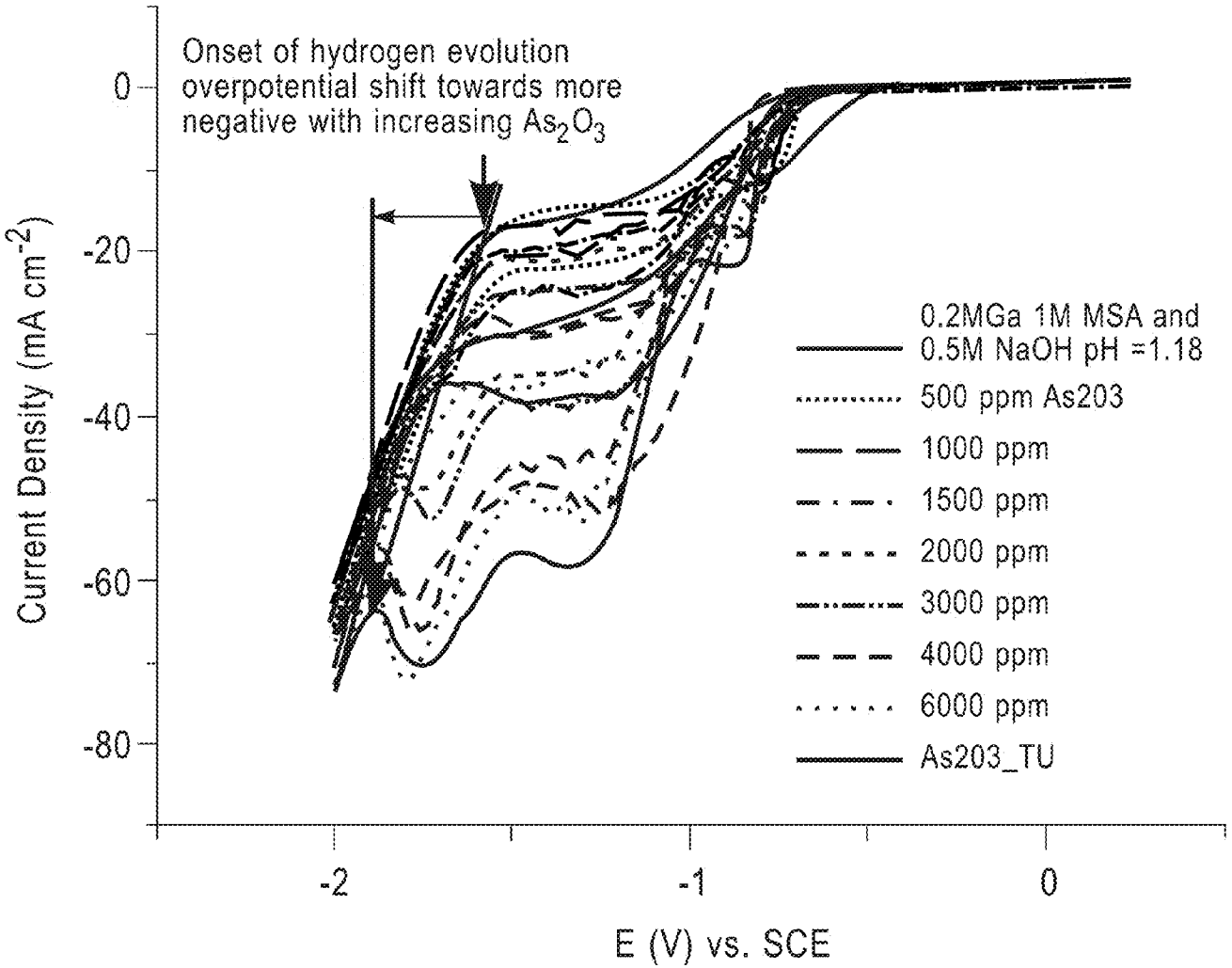

FIG. 9 provides individual cyclic voltammetry plots for the different plating chemistries as labeled. FIG. 10 provides an overlay of the various voltammetry plots and includes data for the combination of $As_2O_3$ and thiourea. As shown, the increasing amounts of $As_2O_3$ provided a negative potential shift for onset of hydrogen evolution over-potential, thereby effectively inhibiting hydrogen generation. In addition, the combination of thiourea and $As_2O_3$ accelerated gallium deposition.

Example 6

Figure 11:
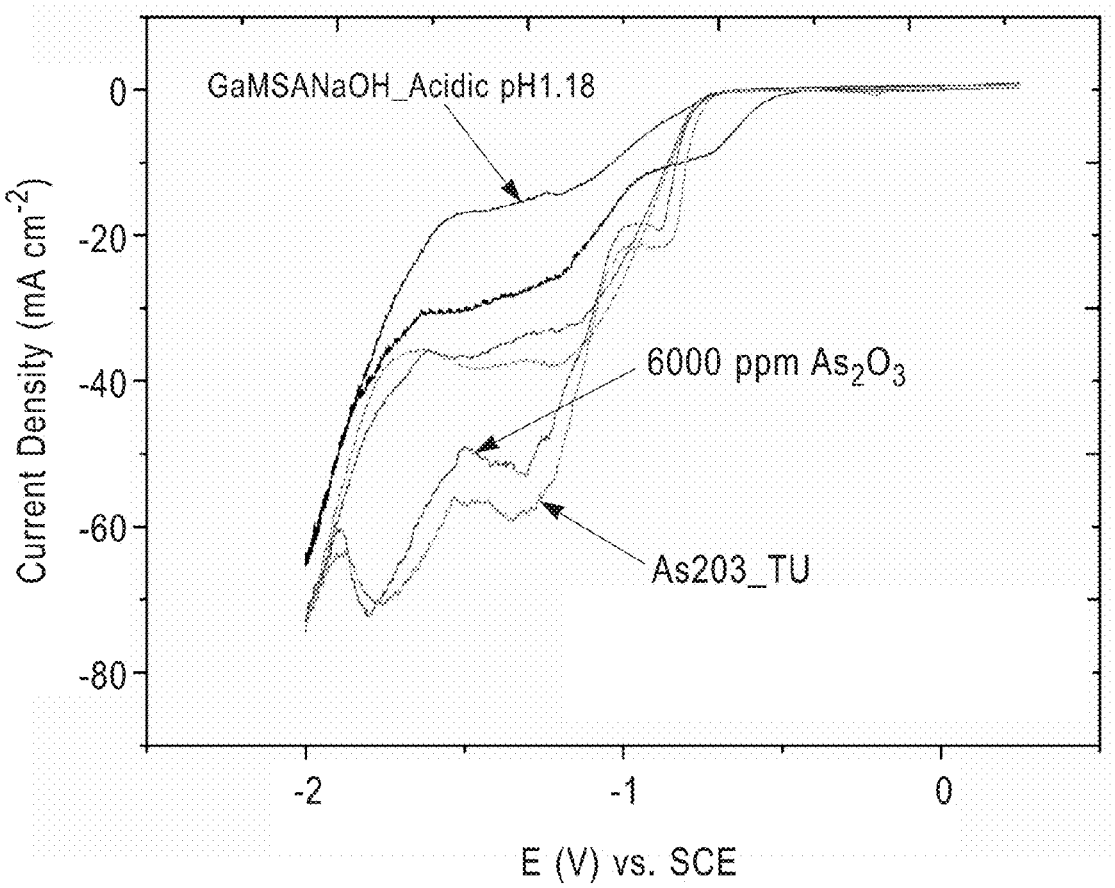
FIG. 11 graphically illustrate cyclic voltammetry plots for acidic gallium plating baths with no additives, with arsenic trioxide additive, and with arsenic trioxide and thiourea as additives.

In this example, the plating bath included 0.25M $Ga^{3+}$ in 0.5 M MSA quenched with 0.5 M NaOH and adjusted to a pH of 1.18 using additional amounts of MSA. Plating was carried out without any additional additives, with 6000 ppm $As_2O_3$, and with 6000 ppm $As_2O_3$ and 500 ppm thiourea. Cyclic voltammetry plots of these plating chemistries are provided in FIG. 11. Inhibition of hydrogen evolution and acceleration of gallium deposition was observed upon addition of $As_2O_3$ and further increases in acceleration with the combination of $As_2O_3$ and thiourea. It has also been shown that the combination of $As_2O_3$ and $As_2O_5$ is also effective for inhibiting the hydrogen evolution (results not shown here). When both of these oxides are combined together then the effect is much effective even at lower concentrations.

Example 7

Figure 12:
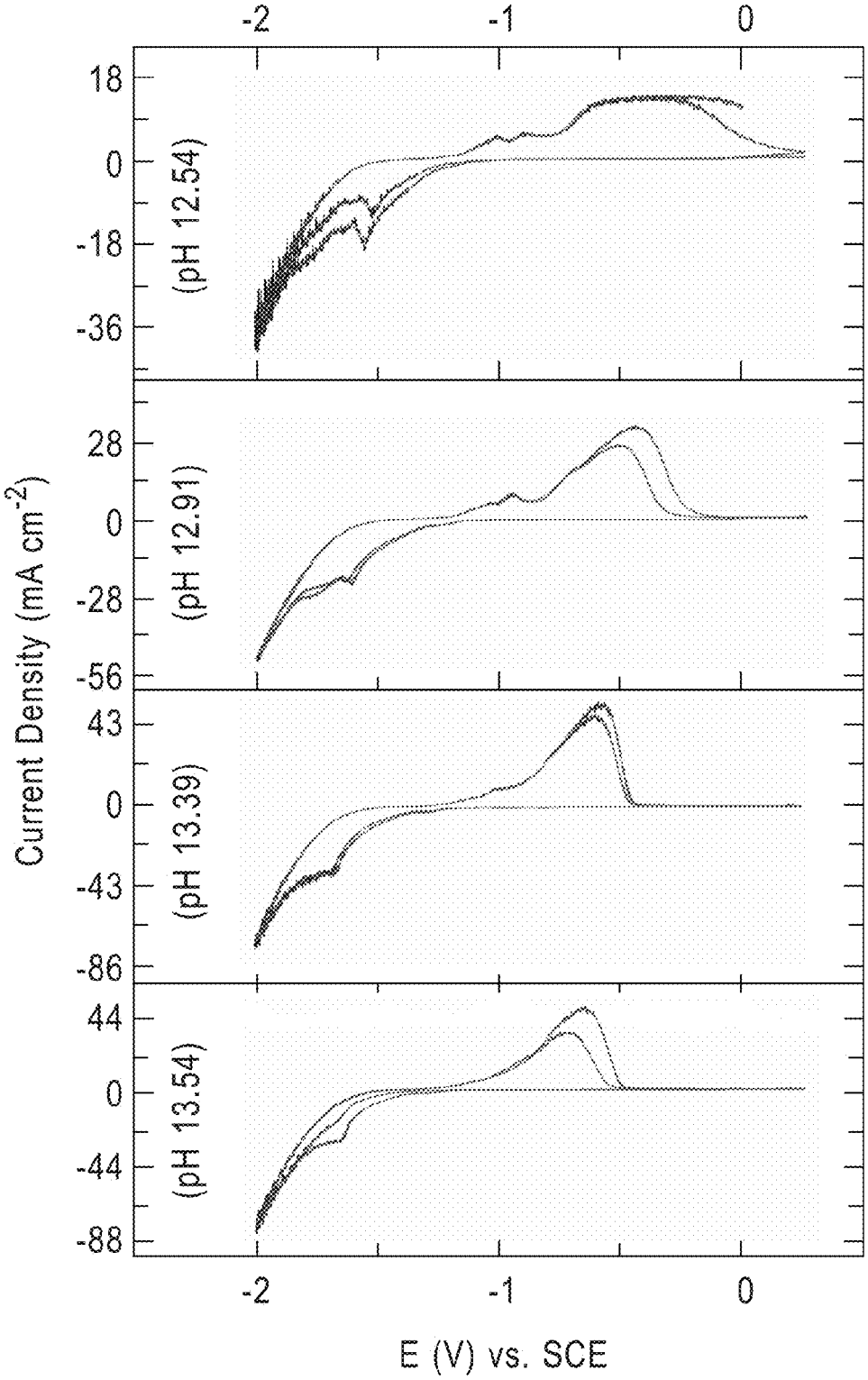
FIG. 12 graphically illustrates cyclic voltammetry plots for various basic gallium plating baths.

In this example, the plating bath include 0.25M $Ga^{3+}$ in 0.5 M MSA quenched with 0.5 M NaOH and adjusted to a pH of about 12 to about 14 using additional amounts of NaOH. Table 3 provides the diffusion limited currents at various pH values and FIG. 12 provides cyclic voltammetry plots for the different pH values.

TABLE 3

| pH | Diffusion Limited Current (mAcm$^{-2}$) |
|---|---|
| 12.54 | 16-17 |
| 12.91 | 28 |
| 13.29 | 41-42 |
| 13.54 | 42-43 |

As shown, cathodic current density was high at the high pH values. Upon increasing the pH further there is no further increase of cathodic current density.

Example 8

Figure 13:
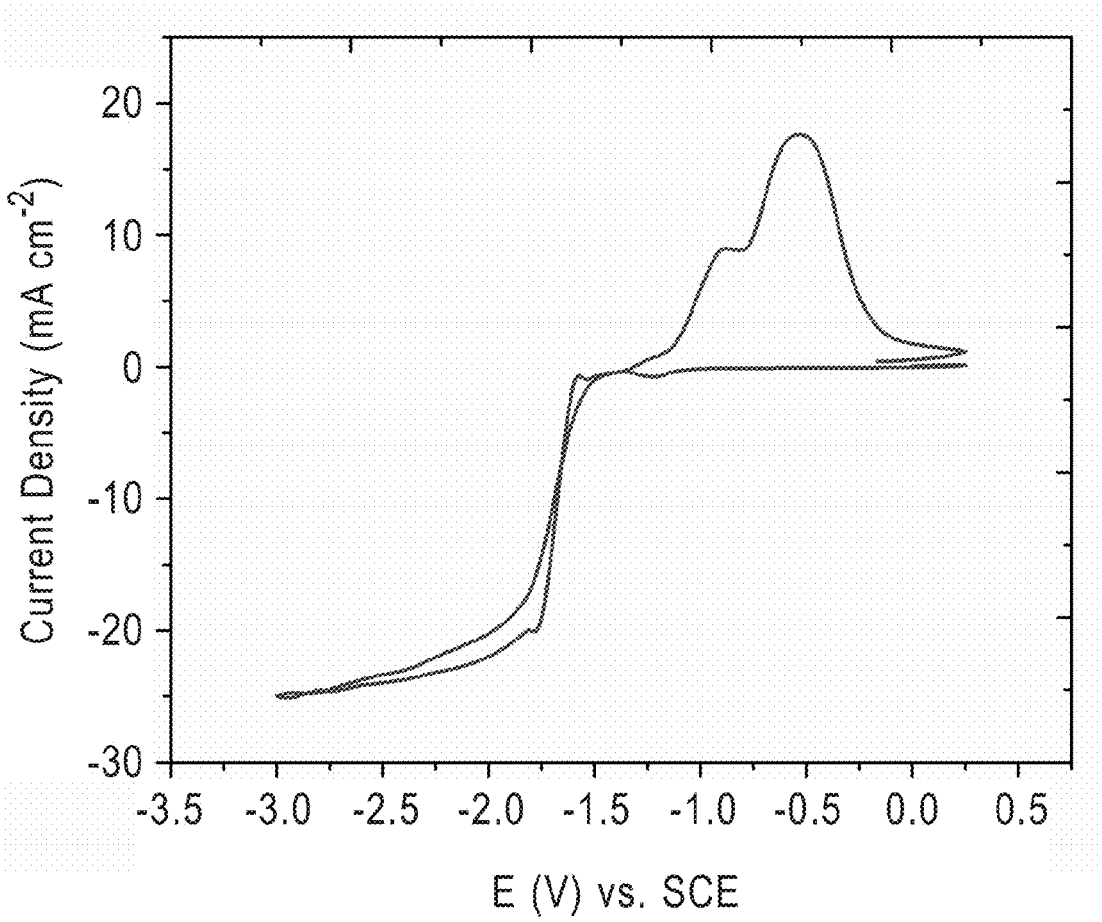
FIG. 13 graphically illustrates a cyclic voltammetry plot of a gallium plating bath in methane sulfonic acid quenched with sodium hydroxide and adjusted to a pH of 13.6.
Figure 14:
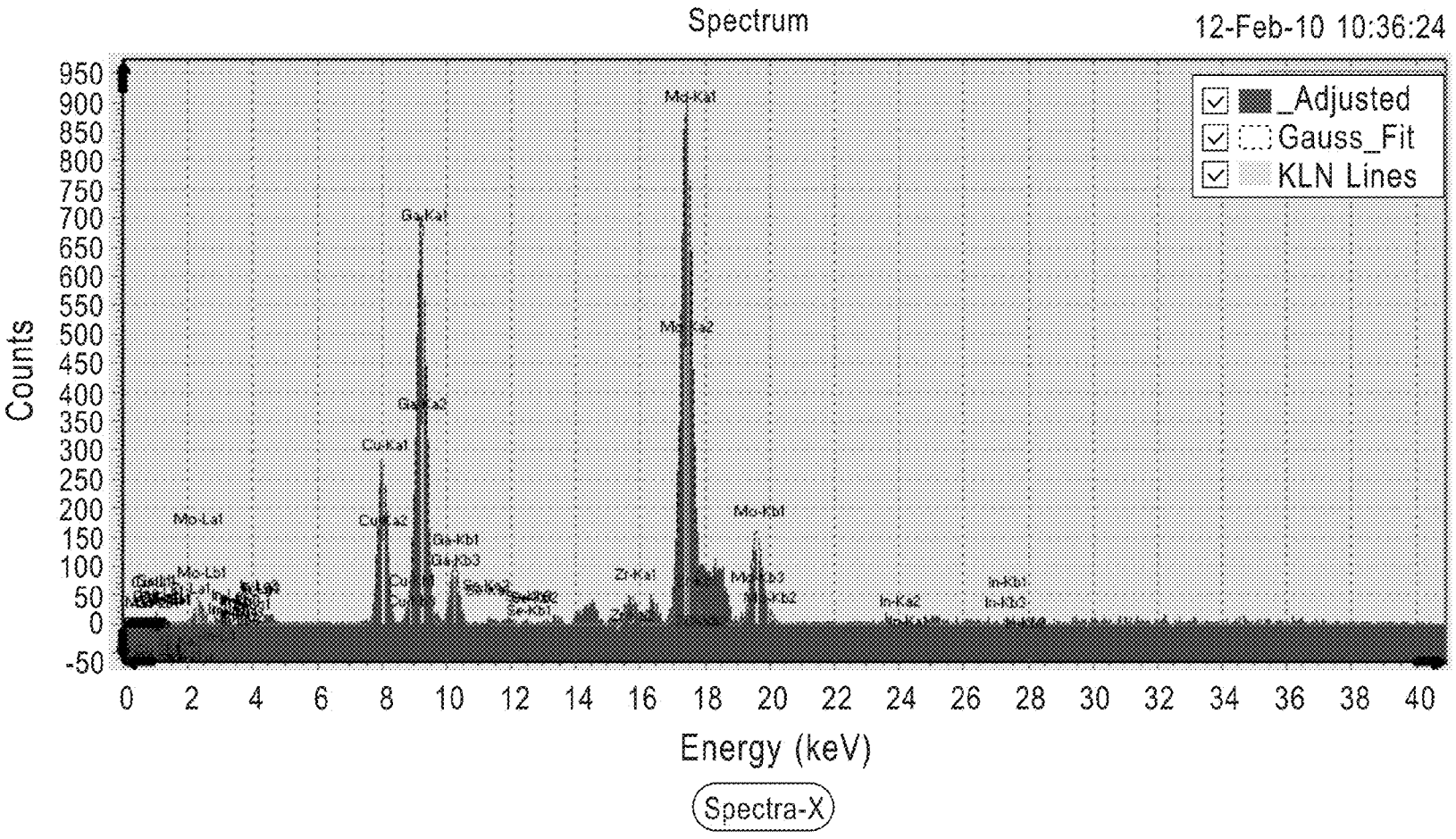
FIG. 14 exhibits the XRF patterns of the deposited gallium film galvanostatically deposited at 20 mA/cm$^2$ from a basic gallium plating bath of pH 13.6 in accordance with the present invention.

In this example, the plating bath include 0.25M $Ga^{3+}$ in 0.5 M MSA quenched with 0.5 M NaOH and adjusted to a pH of 13.6 using additional amounts of NaOH. FIG. 13 provides a current voltage plot, which indicated a kinetically controlled region at about 10 mAcm$^{-2}$. However, no deposition was observed during galvanostatic deposition at 10 mAcm$^{-2}$. In contrast, gallium deposition at 20 mAcm$^{-2}$ onto glass substrates having molybdenum with a copper seed layer was excellent and exhibited plating efficiency of 85 to 95%. FIG.

14 graphically illustrates the XRF patterns of deposited gallium film galvanostatically deposited at 20 $mA/cm^2$.

All ranges disclosed herein are inclusive of the endpoints, and the endpoints are combinable with each other.

All cited patents, patent applications, and other references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method for electrodepositing a substrate, the method comprising:

contacting (i) a solution consisting of a metal salt, wherein the metal salt consists of a metal selected from the group consisting of gallium, and a combination of gallium with copper; methane sulfonic acid; an inorganic metalloid compound selected from the group consisting of arsenic, antimony, bismuth, and a combination thereof; and further optionally an organic additive having at least one sulfur atom; and a solvent to dissolve said metal salt, wherein the solution is free of a complexing agent; and (ii) a substrate;

adjusting pH of the solution to a range selected from the group consisting of from about zero to about 2.6 and greater than about 12.6 to about 14; and applying a current to electroplate the substrate with a metal film consisting essentially of gallium or the combination of gallium and copper, wherein the substrate comprises one or more alloying element metal layers and the method further comprises annealing subsequent to electroplating the metal film.

2. The method of claim 1, wherein adjusting the pH of the solution comprises adding a base to the solution in an amount effective to increase the pH to greater than 12.6 or adding the base followed by adding an additional amount of the methane sulfonic acid in an amount effective to lower the pH to less than 2.6.

3. The method of claim 1, wherein the substrate is conductive.

4. The method of claim 1, wherein the inorganic metalloid compound is at about 1 parts per million to about 10,000 parts per million.

5. The method of claim 1, wherein the methane sulfonic acid is at a concentration of 0.1 M to about 2 M.

6. The method of claim 1, wherein the inorganic metalloid compound is an oxide selected from the group consisting of $As_2O_3$, $As_2O_5$; $KH_2AsO_4$; $K_2HAsO_4$; $K_3AsO_4$; $K_3AsO_3$; $KAsO_2$; $NaH_2AsO_4$; $Na_2HAsO_4$; $Na_3AsO_4$; $Na_3AsO_3$; $NaAsO_2$; $Na_4As_2O_7$; $Sb_2O_3$; $Sb_2O_5$; $KH_2SbO_4$; $K_2HSbO_4$; $K_3SbO_4$; $K_3SbO_3$; $KSbO_2$; $NaH_2SbO_4$; $Na_2HSbO_4$; $Na_3SbO_4$; $Na_3SbO_3$; $NaSbO_2$; $Na_4Sb_2O_7$; $Bi_2O_3$; $K_3BiO_3$; $KBiO_2$; $Na_3BiO_3$; NaBiO; and mixtures thereof.

7. A method for electrodepositing a substrate, the method comprising:

contacting (i) a solution consisting of a metal salt, wherein the metal salt consists of a metal selected from the group consisting of gallium, and a combination of gallium with copper; methane sulfonic acid; an inorganic metalloid compound selected from the group consisting of arsenic, antimony, bismuth, and a combination thereof; and a solvent to dissolve said metal salt, wherein the solution is free of a complexing agent; and (ii) a substrate;

adjusting pH of the solution to a range selected from the group consisting of from about zero to about 2.6 and greater than about 12.6 to about 14; and applying a current to electroplate the substrate with a metal containing film.

8. A method for electrodepositing a substrate, the method comprising:

contacting (i) a solution consisting of a metal salt, wherein the metal salt consists of a metal selected from the group consisting of gallium, and a combination of gallium with copper; methane sulfonic acid; an inorganic metalloid compound selected from the group consisting of arsenic, antimony, bismuth, and a combination thereof; an organic additive having at least one sulfur atom; and a solvent to dissolve said metal salt, wherein the solution is free of a complexing agent; and (ii) a substrate;

adjusting pH of the solution to a range selected from the group consisting of from about zero to about 2.6 and greater than about 12.6 to about 14; and applying a current to electroplate the substrate with a metal containing film.

* * * * *